US007221213B2

(12) United States Patent
Lee et al.

(10) Patent No.: US 7,221,213 B2
(45) Date of Patent: May 22, 2007

(54) VOLTAGE REGULATOR WITH PREVENTION FROM OVERVOLTAGE AT LOAD TRANSIENTS

(75) Inventors: Rong-Chin Lee, Pingtung County (TW); Fang-Te Su, Kaohsiung County (TW)

(73) Assignee: Aimtron Technology Corp., Hsinchu (TW)

( * ) Notice: Subject to any disclaimer, the term of this patent is extended or adjusted under 35 U.S.C. 154(b) by 60 days.

(21) Appl. No.: 11/161,582

(22) Filed: Aug. 8, 2005

(65) Prior Publication Data

US 2007/0030054 A1 Feb. 8, 2007

(51) Int. Cl.
*G05F 1/10* (2006.01)

(52) U.S. Cl. ..... 327/541; 323/280

(58) Field of Classification Search ..... 323/265, 323/273, 280, 281; 327/535, 540, 541
See application file for complete search history.

(56) References Cited

U.S. PATENT DOCUMENTS

| | | | | |
|---|---|---|---|---|
| 5,864,227 | A | 1/1999 | Borden et al. | |
| 5,912,550 | A * | 6/1999 | Sharpe-Geisler | 323/273 |
| 6,201,375 | B1 | 3/2001 | Larson et al. | |
| 6,333,623 | B1 | 12/2001 | Heisley et al. | |
| 6,377,033 | B2 | 4/2002 | Hsu | |
| 6,388,433 | B2 | 5/2002 | Marty | |
| 6,979,984 | B2 * | 12/2005 | Perrier et al. | 323/281 |

* cited by examiner

*Primary Examiner*—Jeffrey Zweizig
(74) *Attorney, Agent, or Firm*—Winston Hsu

(57) ABSTRACT

A voltage converting circuit has an output terminal for supplying an output current at an output voltage to a load. In response to a transient of the load, a current sinking circuit allows a current source to provide a sink current flowing from the output terminal of the voltage converting circuit into a ground potential. The sink current is finite and stable. When the output voltage decreases below a threshold voltage, the current sinking circuit allows the current source to keep providing the finite and stable sink current for an extension time, causing the output voltage to decrease from the threshold voltage to a regulated value.

18 Claims, 3 Drawing Sheets

VOLTAGE REGULATOR WITH PREVENTION FROM OVERVOLTAGE AT LOAD TRANSIENTS

BACKGROUND OF THE INVENTION

1. Field of the Invention

The present invention relates to a voltage regulator and, more particularly, to a voltage regulator capable of stabilizing output voltages at load transients.

2. Description of the Prior Art

FIG. 1(A) is a circuit diagram showing a first example of a conventional linear regulator 11. The linear regulator 11 converts an input voltage $V_{in}$ into an output voltage $V_{out}$, and supplies an output current $I_{out}$ in accordance with a requirement of a load $I_d$. A resistive voltage divider formed of series-connected resistors R1 and R2 generates a feedback voltage $V_{fb}$ representative of the output voltage $V_{out}$. Through comparing the feedback voltage $V_{fb}$ and a predetermined reference voltage $V_{ref}$, an error amplifier 13 generates and applies an error voltage $V_{err}$ to a gate electrode of a transistor PQ. The drain-source current channel of the transistor PQ is connected between the input voltage $V_{in}$ and the output voltage $V_{out}$. As the error voltage $V_{err}$ is applied to control the resistance of the drain-source current channel, the linear regulator 11 maintains the output voltage $V_{out}$ at a regulated value and supplies the output current $I_{out}$ in accordance with the requirement of the load $I_d$. As shown in FIG. 1(B), which is a second example of a conventional linear regulator 12, an NMOS transistor NS may replace the PMOS transistor PQ and then function as a passive element between the input voltage $V_{in}$ and the output voltage $V_{out}$. However in this case, the non-inverting input terminal of the error amplifier 13 is changed to receive the reference voltage $V_{ref}$ while the inverting input terminal is changed to receive the feedback voltage $V_{fb}$.

When the load $I_d$ makes a transient from heavy loading to light loading, e.g., the load $I_d$ is suddenly removed, an excessive portion of the output current $I_{out}$ turns to charge the output capacitor $C_{out}$ before the output current $I_{out}$ eventually reduces to become equal to the light load $I_d$ in response to this transient. As a result, the output voltage $V_{out}$ is raised out of the regulated value. In order to overcome this problem and suppress the overshooting of the output voltage $V_{out}$, the prior art suggests a current sinking circuit for providing the excessive portion of the output current $I_{out}$ with a sinking path when the load transients occur.

In the first example of FIG. 1(A), the current sinking circuit 14*a* primarily includes a voltage comparator 15 and a switching transistor PS. When the load $I_d$ makes a transient from heavy loading to light loading and then causes the output voltage $V_{out}$ to rise as mentioned earlier, the error amplifier 13 also correspondingly generates a rising error voltage $V_{err}$. Once the error voltage $V_{err}$ reaches a predetermined trigger voltage $V_{trg}$, the voltage comparator 15 turns on the switching transistor PS so as to form a sinking path for short-circuiting the output current $I_{out}$ into the ground potential. In the second example of FIG. 1(B), the voltage comparator 15 of the current sinking circuit 14*b* is provided to compare the reference voltage $V_{ref}$ and the feedback voltage $V_{fb}$ level-shifted by a predetermined offset voltage $V_{ofs}$. When the feedback voltage $V_{fb}$ becomes large enough to trigger the voltage comparator 15, the switching transistor NS is turned on so as to form a sinking path for short-circuiting the output current $I_{out}$ into the ground potential.

Although the prior art of FIG. 1(A) or 1(B) uses the current sinking circuit 14*a* or 14*b* to provide the sinking path for suppressing the overshooting of output voltage $V_{out}$, the output current $I_{out}$ is in fact dramatically pulled down since the switching transistor PS or NS when turned on short-circuits the output terminal of the linear regulator 11 or 12 directly to the ground potential. As an adverse result, the output voltage $V_{out}$ is prone to oscillating at a high frequency and actually causes the current sinking circuit 14*a* or 14*b* to repeatedly turn the switching transistor PS or NS between on and off.

SUMMARY OF THE INVENTION

In view of the above-mentioned problems, an object of the present invention is to provide a voltage regulator capable of preventing from overshooting and oscillating of the output voltage at load transients, thereby providing a stable output voltage.

According the present invention, a voltage regulator includes a voltage converting circuit, an event detecting circuit, and a current sinking circuit. The voltage converting circuit has an output terminal for supplying an output current at an output voltage to a load. The event detecting circuit detects a transient of the load. In response to the transient of the load, the current sinking circuit allows a current source to provide a sink current flowing from the output terminal of the voltage converting circuit into a ground potential. The sink current is finite and stable. When the output voltage decreases to a predetermined threshold voltage, the current sinking circuit allows the current source to continuously provide the finite and stable sink current for a predetermined extension time, causing the output voltage to decrease from the threshold voltage to a regulated value.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The above-mentioned and other objects, features, and advantages of the present invention will become apparent with reference to the following descriptions and accompanying drawings, wherein.

DETAILED DESCRIPTION

The preferred embodiments according to the present invention will be described in detail with reference to the drawings.

Figure 2A:
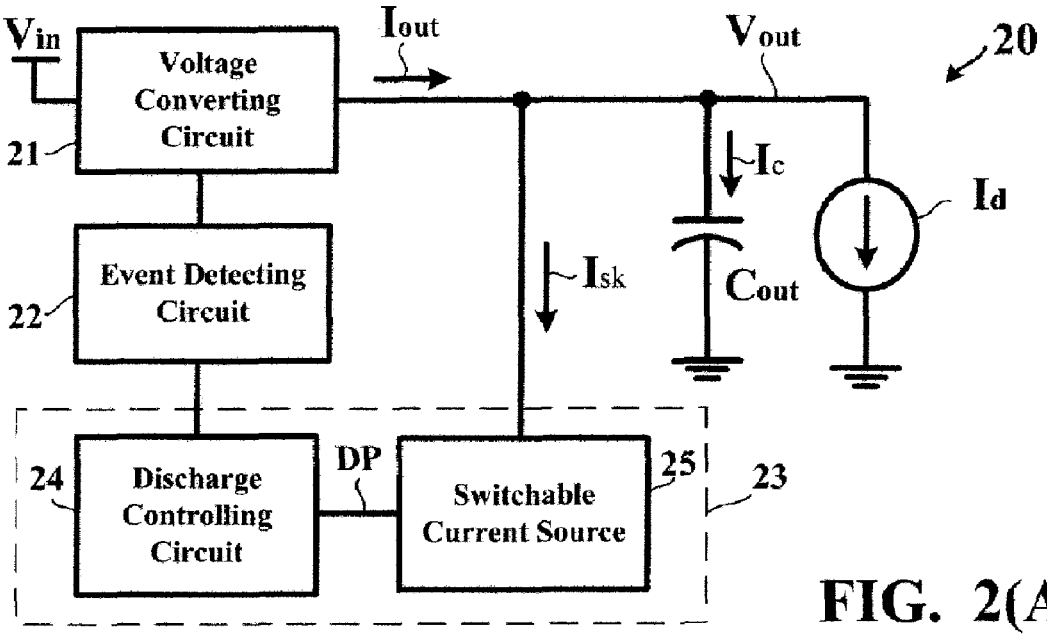
FIG. 2(A) is a circuit block diagram showing a voltage regulator according to the present invention.

FIG. 2(A) is a circuit block diagram showing a voltage regulator 20 according to the present invention. Referring to FIG. 2(A), the voltage regulator 20 primarily includes a voltage converting circuit 21, an event detecting circuit 22, and a current sinking circuit 23. The current sinking circuit 23 primarily includes a discharge controlling circuit 24 and a switchable current source 25.

Figure 1A:
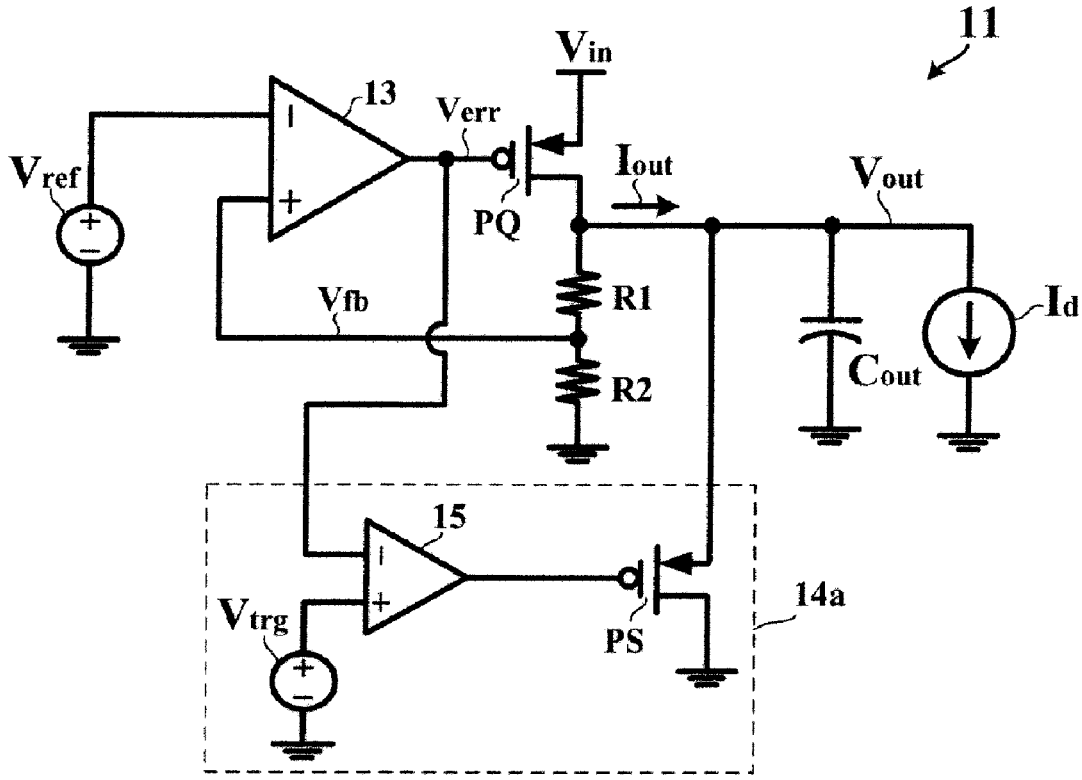
FIG. 1(A) (Prior Art)
FIG. 1(A) is a circuit diagram showing a first example of a conventional linear regulator.
Figure 1B:
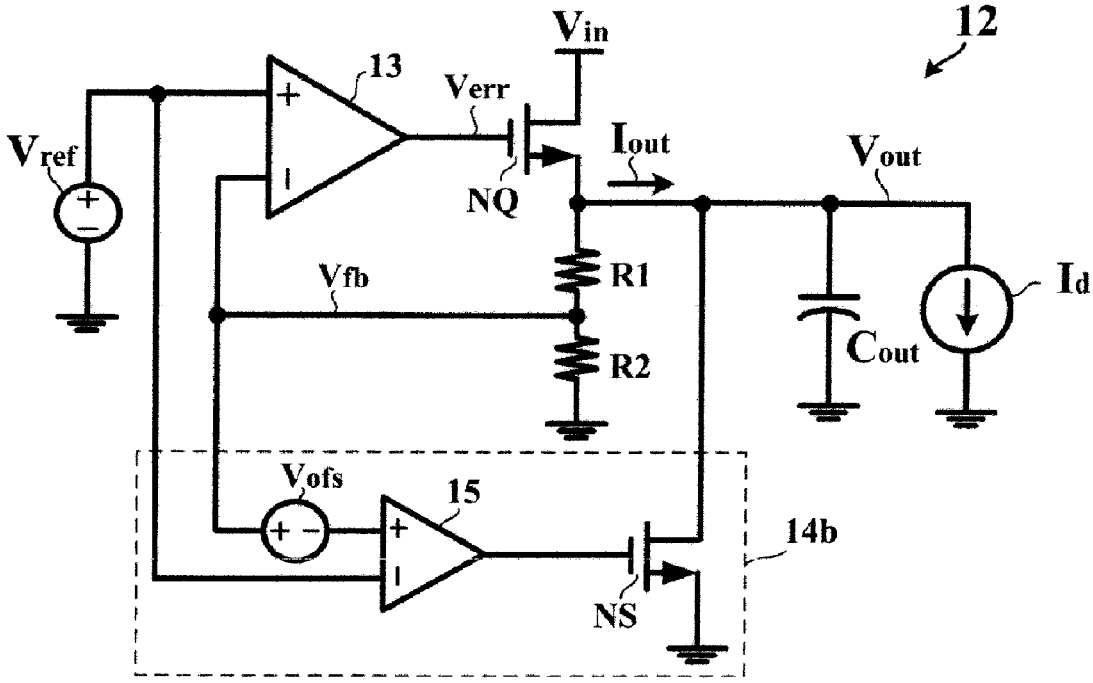
FIG. 1(B) (Prior Art)
FIG. 1(B) is a circuit diagram showing a second example of a conventional linear regulator.

Speaking in general, the voltage converting circuit 21 is a type of circuit that converts an input voltage $V_{in}$ into an output voltage $V_{out}$ and supplies an output current $I_{out}$ at the output voltage $V_{out}$ through an output terminal in accordance with a requirement of a load $I_d$. The voltage converting circuit 21 may be implemented by the linear regulator 11 or 12 shown in FIG. 1(A) or 1(B), i.e. consisting of a voltage divider, an error amplifier, and a transistor as a passive element. In addition, the voltage converting circuit 21 may also be implemented by a switching regulator utilizing a pulse width modulation or pulse frequency modulation technique. Still alternatively, the voltage converting circuit 21 may be implemented by a charge pump regulator. Since both of the switching regulator and the charge pump regulator are well known in the prior art, the detailed descriptions thereof are omitted hereinafter.

The event detecting circuit 22 is provided to detect for a transient of the load $I_d$, especially for a transient from heavy loading to light loading. Since the output voltage $V_{out}$ is raised due to the charging of the output capacitor $C_{out}$, as mentioned earlier, when the load $I_d$ makes a transient from heavy loading to light loading, the event detecting circuit 22 may be implemented by a voltage comparator for determining whether the output voltage $V_{out}$ is rising over a predetermined threshold voltage $V_{th}$. In addition to the direct detection of the output voltage $V_{out}$, the event detecting circuit 22 may detect any of the signals associated with the output voltage $V_{out}$, for example, the error voltage $V_{err}$ or the feedback voltage $V_{fb}$, both of which changes depending on the output voltage $V_{out}$. Therefore, the event detecting circuit 22 may be implemented by the voltage comparator 15 of FIG. 1(A), which effectively determines the transient of the load $I_d$ by comparing the error voltage $V_{err}$ and the trigger voltage $V_{trg}$. Alternatively, the event detecting circuit 22 may be implemented by the voltage comparator 15 of FIG. 1(B), which effectively determines the transient of the load $I_d$ by comparing the feedback voltage $V_{fb}$ minus the offset voltage $V_{ofs}$ and the reference voltage $V_{ref}$.

In response to the transient of the load $I_d$ detected by the event detecting circuit 22, the discharge controlling circuit 24 generates a discharge control signal DP for controlling the switchable current source 25. More specifically, when the output voltage $V_{out}$ is rising above a predetermined threshold voltage $V_{th}$, the discharge control signal DP activates or turns on the switchable current source 25 for allowing a sink current $I_{sk}$ to flow from the output terminal of the voltage converting circuit 21 into the ground potential. However, once the output voltage $V_{out}$ decreases below the threshold voltage $V_{th}$ due to the sink current $I_{sk}$, the discharge control signal DP starts extending a predetermined time for continuously allowing the switchable current source 25 to provide the sink current $I_{sk}$ in order to make sure the output voltage $V_{out}$ returns to the regulated value prior to the transient event. It should be noted that the switchable current source 25 is activated or turned on for providing a finite and stable sink current $I_{sk}$, instead of short-circuiting the output terminal of the voltage converting circuit 21 directly to the ground potential, thereby achieving a stable decrease in the output voltage $V_{out}$ without oscillations.

Figure 2B:
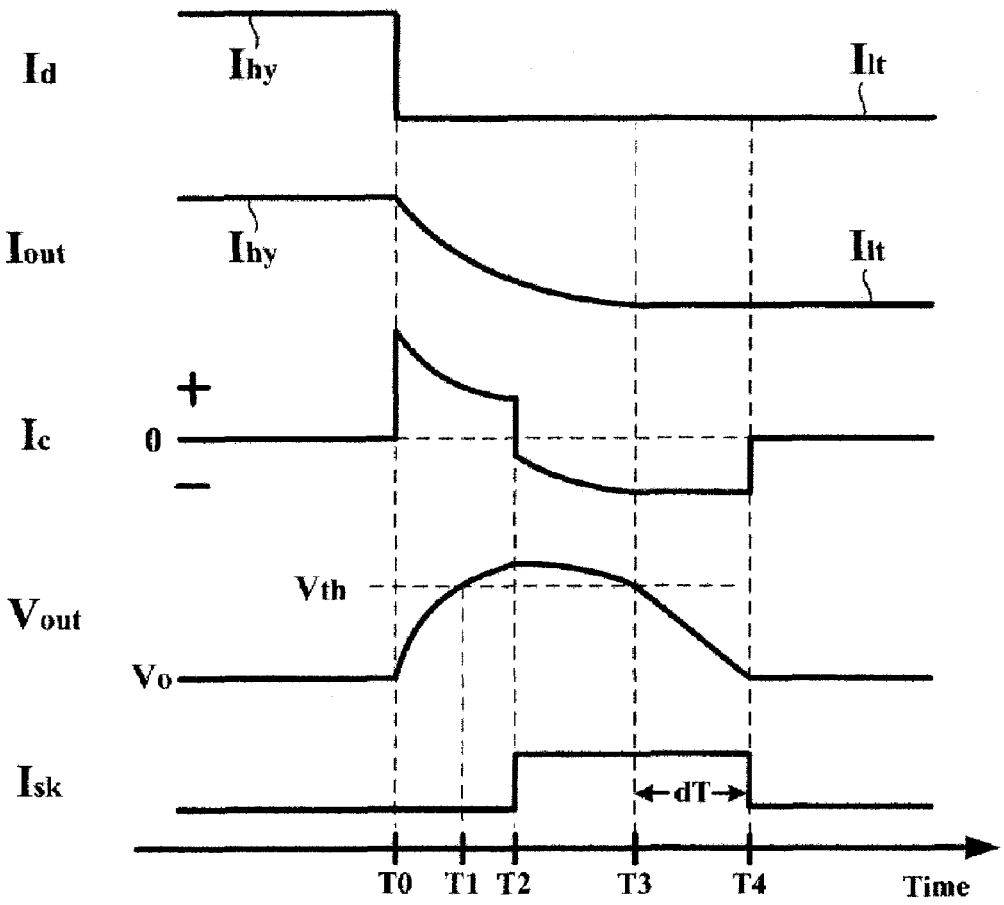
FIG. 2(B) is a timing chart showing an operation of a voltage regulator according to the present invention.

FIG. 2(B) is a timing chart showing an operation of a voltage regulator 20 according to the present invention. At time T0, the load $I_d$ makes a transient from heavy loading $I_{hy}$ to light loading $I_{lt}$, resulting in some of the output current $I_{out}$ turns to charge the output capacitor $C_{out}$ as a capacitor current $I_c$. Therefore, the output voltage $V_{out}$ starts rising at time T0. After the output voltage $V_{out}$ reaches a predetermined threshold voltage $V_{th}$ at time T1, the event detecting circuit 22 is triggered to activate or turn on the current sinking circuit 23. Delayed slightly by the realistic, finite operation speed of circuit, at time T2 is the switchable current source 25 activated or turned on to provide the finite and stable sink current $I_{sk}$. As a result, the capacitor current $I_c$ is subjected to a sudden but finite change and most likely reverses from the positive direction (+) to the negative direction (−) to discharge the output capacitor $C_{out}$ as shown in figure. It should be noted that at time T3 the output voltage $V_{out}$ decreases to the threshold voltage $V_{th}$, but the sink current $I_{sk}$ is continuously supplied by the switchable current source 25. The sink current $I_{sk}$ is kept flowing from time T3 through time T4 such that the output voltage $V_{out}$ returns to the original regulated value $V_0$ from the threshold voltage $V_{th}$. In other words, the current sinking circuit 23 is designed to maintain the supply of the sink current $I_{sk}$ until the output voltage $V_{out}$ returns to the original regulated value $V_o$. Now assumed that during time T3 through time T4, the sink current $I_{sk}$ is dedicated to discharging the extra charge of the output capacitor $C_{out}$, i.e. at this phase the output current $I_{out}$ has almost completely been modulated to the light loading lit in response to the transient. If in one embodiment the current sinking circuit 23 provides a constant sink current $I_{sk}$, the extension time dT can be approximately calculated by the equation: $dT=C_{out}/I_{sk}*(V_{th}-V_o)$.

Figure 3:
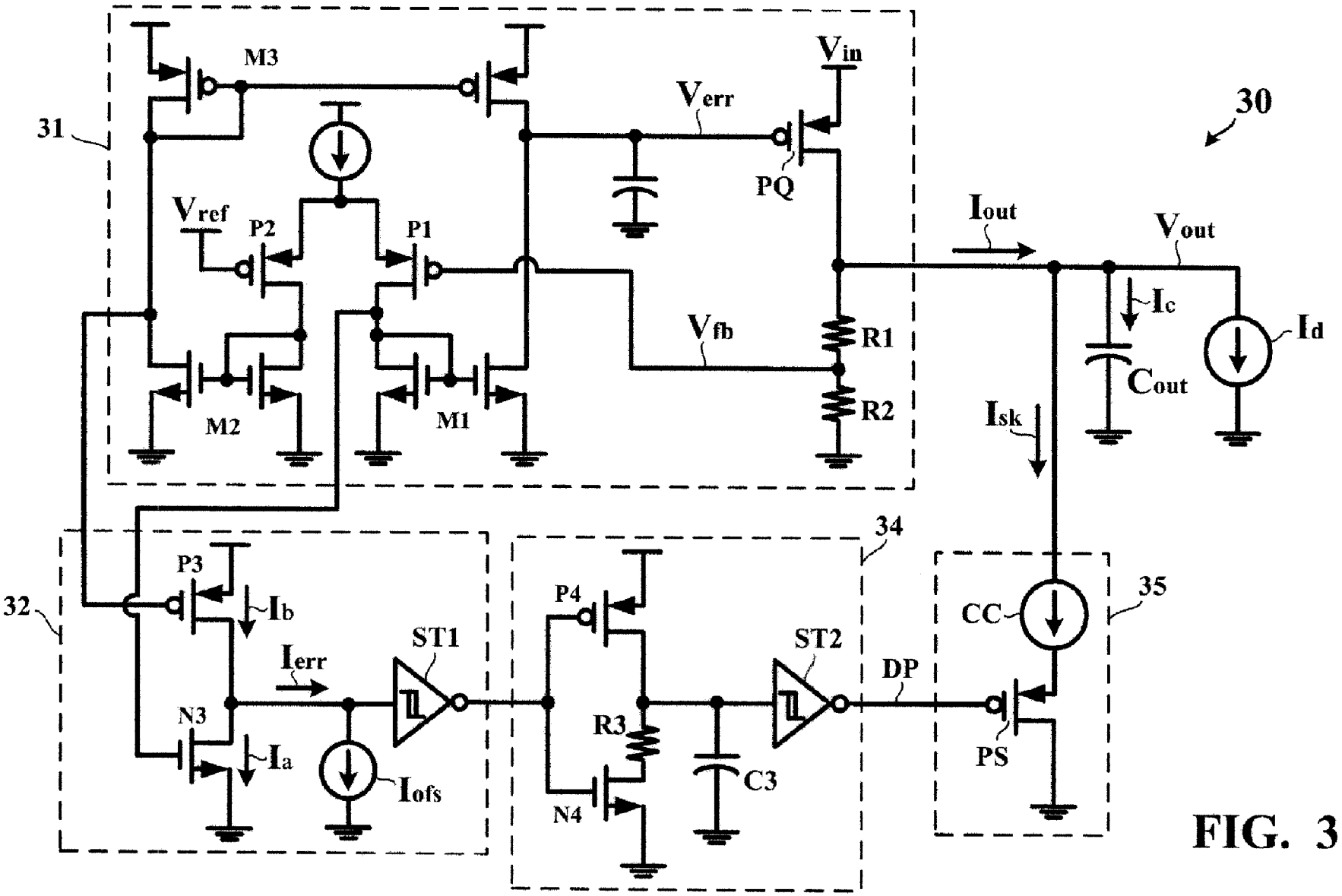
FIG. 3 is a detailed circuit diagram showing one example of a voltage regulator according to the present invention.

FIG. 3 is a detailed circuit diagram showing one example of a voltage regulator 30 according to the present invention. In a voltage converting circuit 31, a differential amplifying pair is made up of transistors P1 and P2 and current mirrors M1, M2, and M3 for comparing the feedback voltage $V_{fb}$ and the reference voltage $V_{ref}$, and then generating the error voltage $V_{err}$ to control the current channel resistance of the transistor PQ connected between the input voltage $V_{in}$ and the output voltage $V_{out}$. Therefore, the voltage converting circuit 31 is implemented by a linear regulator.

In an event detecting circuit 32, based on the current mirroring symmetry of design, through a transistor N3 flows a current $I_a$, which is proportional to the current flowing through the transistor P1 of the differential amplifying pair, and through a transistor P3 flows a current $I_b$, which is proportional to the current flowing through the transistor P2 of the differential amplifying pair. Because the differential amplifying pair distributes the currents among the transistors P1 and P2 in accordance with the feedback voltage $V_{fb}$ and the reference voltage $V_{ref}$, the difference between the currents $I_a$ and $I_b$ appropriately reflects the difference between the feedback voltage $V_{fb}$ and the reference voltage $V_{ref}$. When an error current $I_{err}$ between the currents $I_a$ and $I_b$ rises above a predetermined offset current $I_{ofs}$, a Schmidt trigger STI is triggered. For this reason, the event detecting circuit 32 may be considered as a current comparator utilizing the current comparison to detect for the transient of the load $I_d$.

After the Schmidt trigger STI is triggered to output a low level, in a discharge controlling circuit 34 is a transistor P4 turned on and a transistor N4 off, resulting in a charge current flowing through the transistor P4 into a capacitor C3. Rapidly, the potential difference across the capacitor C3 becomes large enough for triggering a Schmidt trigger ST2 to generate a discharge control signal DP at a low level. In response to the low level of the discharge control signal DP, a switching transistor PS of a switchable current source 35 is turned on to allow a current source CC to provide a finite and stable sink current $I_{sk}$. In one embodiment, the current source CC may be implemented by a constant current source for supplying a constant sink current $I_{sk}$. When the Schmidt trigger ST1 of the event detecting circuit 32 changes its output to a high level, i.e. the output voltage $V_{out}$ decreases to the threshold voltage $V_{th}$ due to the sink current $I_{sk}$, the transistor P4 is turned off and the transistor N4 is turned on in the discharge controlling circuit 34. As a result, the capacitor C3 is discharged through a resistor R3 and the transistor N4. Because the discharge rate of the capacitor C3 is made slower than the charge rate due to the resistor R3, the discharge control signal DP maintains at the low level for an extension time dT to allow the switchable current source 35 to continuously supply the sink current $I_{sk}$.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage regulator comprising:

a voltage converting circuit having an output terminal for supplying an output current at an output voltage to a load;

an event detecting circuit for detecting a transient of the load; and a current sinking circuit for, in response to the transient of the load, allowing a current source to provide a finite and stable sink current flowing from the output terminal of the voltage converting circuit into a ground potential, wherein:

the current sinking circuit allows the current source to continuously provide the finite and stable sink current for a predetermined extension time when the output voltage decreases to a predetermined threshold voltage.

2. The voltage regulator according to claim 1, wherein:

the finite and stable sink current has a constant magnitude.

3. The voltage regulator according to claim 1, wherein:

in response to the transient of the load, the current sinking circuit allows the current source to provide the finite and stable sink current for a predetermined sink time.

4. The voltage regulator according to claim 1, wherein:

the predetermined extension time is designed for decreasing the output voltage from the predetermined threshold voltage to a predetermined regulated value.

5. The voltage regulator according to claim 1, wherein:

the event detecting circuit is implemented by a voltage comparator for comparing the output voltage and a predetermined reference voltage.

6. The voltage regulator according to claim 1, wherein:

the voltage converting circuit has a feedback circuit for generating a feedback voltage representative of the output voltage, and the event detecting circuit is implemented by a voltage comparator for comparing the feedback voltage and a predetermined reference voltage.

7. The voltage regulator according to claim 6, wherein:

the event detecting circuit is triggered when a difference between the feedback voltage and the predetermined reference voltage reaches a predetermined offset voltage.

8. The voltage regulator according to claim 1, wherein:

the voltage converting circuit includes:

a feedback circuit for generating a feedback voltage representative of the output voltage, and an error amplifying circuit for generating an error voltage representative of a difference between the feedback voltage and a first reference voltage, and the event detecting circuit is implemented by a voltage comparator for comparing the error voltage and a second reference voltage.

9. The voltage regulator according to claim 1, wherein:

the voltage converting circuit includes:

a feedback circuit for generating a feedback voltage representative of the output voltage, and a differential amplifying pair for distributing a first current and a second current in accordance with the feedback voltage and a predetermined reference voltage, and the event detecting circuit is implemented by a current comparator for comparing the first current and the second current.

10. The voltage regulator according to claim 9, wherein:

the event detecting circuit is triggered when a difference between the first current and the second current reaches a predetermined offset current.

11. The voltage regulator according to claim 1, wherein:

the voltage converting circuit is implemented by a linear voltage regulator.

12. A method of preventing overvoltage of a voltage regulator having an output terminal for supplying an output current at an output voltage to a load, the method comprising:

allowing a current source to provide a finite and stable sink current flowing from the output terminal of the voltage converting circuit into a ground potential when the output voltage increases over a predetermined threshold voltage, and allowing the current source to continuously provide the finite and stable sink current for a predetermined extension time when the output voltage decreases below the predetermined threshold voltage.

13. The method according to claim 12, wherein:

the predetermined extension time is designed to decrease the output voltage from the predetermined threshold voltage to a predetermined regulated value.

14. The method according to claim 12, wherein:

the finite and stable sink current has a constant magnitude.

15. A voltage regulator comprising:

a current channeling circuit having an input terminal for receiving an input voltage, an output terminal for supplying an output current at an output voltage to a load, and a control terminal;

a feedback circuit for generating a feedback voltage representative of the output voltage;

a differential amplifying pair for generating an error voltage representative of a difference between the feedback voltage and a predetermined reference voltage, the error voltage being applied to the control terminal of the current channeling circuit, and the differential amplifying pair for distributing a first current and a second current in accordance with the output voltage and the predetermined reference voltage;

a current comparator for comparing the first current and the second current;

a discharge controlling circuit controlled by the current comparator for generating a discharge control signal; and a switchable current source for, in response to the discharge control signal, allowing a current source to provide a finite and stable sink current flowing from the output terminal of the current channeling circuit into a ground potential.

16. The voltage regulator according to claim 15, wherein: the switchable current source includes:

a switching circuit controlled by the discharge control signal, and a constant current source for providing a constant current as the finite and stable sink current when the switching circuit is turned on.

17. The voltage regulator according to claim 15, wherein: the discharge control signal allows the switchable current source to continuously provide the finite and stable sink current for a predetermined extension time when the output voltage decreases below a predetermined threshold voltage.

18. The voltage regulator according to claim 17, wherein: the predetermined extension time is designed to decrease the output voltage from the predetermined threshold voltage to a predetermined regulated value.

* * * * *